United States Patent [19]

Nakamura et al.

[11] Patent Number: 4,771,745

[45] Date of Patent: Sep. 20, 1988

[54] STRUCTURE OF INTERNAL COMBUSTION ENGINE

[75] Inventors: Noboru Nakamura, Kyoto; Hiroyasu Endo, Nagaokakyo; Sadakatu Ushio, Otsu; Tetsuo Ebisudani, Hirakata; Mitsunori Ito, Uji; Tokiichi Mizukami; Mitsuru Kishimoto, both of Kyoto, all of Japan

[73] Assignee: Mitsubishi Jidosha Kogyo Kabushiki Kaishi, Tokyo, Japan

[21] Appl. No.: 41,451

[22] Filed: Apr. 23, 1987

[30] Foreign Application Priority Data

Apr. 28, 1986 [JP] Japan ..... 61-64674
Apr. 28, 1986 [JP] Japan ..... 61-64675

[51] Int. Cl.[4] ..... F01M 1/00

[52] U.S. Cl. ..... 123/196 R; 123/196 M; 123/90.33; 184/6.9

[58] Field of Search ..... 123/196 R, 196 M, 90.33, 123/90.34, 90.35, 90.36, 90.37, 90.38; 184/6.9

[56] References Cited

U.S. PATENT DOCUMENTS

| | | | |
|---|---|---|---|
| 4,343,270 | 8/1982 | Kawabe | 123/90.3 X |
| 4,404,936 | 8/1983 | Tatebe et al. | 123/196 R |
| 4,501,234 | 2/1985 | Toki et al. | 123/196 R |
| 4,563,986 | 1/1986 | Nakano | 123/196 M |
| 4,649,873 | 3/1987 | Amano | 123/90.33 |

*Primary Examiner*—E. Rollins Cross
*Attorney, Agent, or Firm*—Oldham & Oldham Co.

[57] ABSTRACT

A structure of internal combustion engine comprises a cylinder member composed of a cylinder which accomodates a piston connected with a crankshaft, a crankcase provided to accomodate said crankshaft, a rocker case provided to accomodate a valve actuating mechanism, an oil return passage constituting means for leading oil in said rocker case into said crankcase, and a restraining means for restraining an air flow within said crankcase from entering into said oil return passage constituting means. By the effect of the restraining means provided in relation to the oil return passage constituting means, the air flow generated by the rotation of the crankshaft does not work as a dynamic pressure of hingering the flowingdown of oil.

6 Claims, 5 Drawing Sheets

STRUCTURE OF INTERNAL COMBUSTION ENGINE

BACKGROUND OF THE INVENTION

The invention relates to a structure of internal combustion engine for returning oil which has been fed to a valve actuating mechanism and then received on the top surface of a cylinder head into a crankcase.

In FIG. 5 showing a conventional structure of internal combustion engine, the reference numeral 1 represents a cylinder block; 2 is a cylinder head; 3 is a rocker cover demarcating a rocker case in cooperation with the cylinder head 2; and 4 is an oil pan. The lower part of the cylinder block 1 and the oil pan 4 constitute a crankcase 5. Within the crankcase 5, there is arranged a crankshaft 7 which rotates in the direction that an arrow shows, with a connecting rod 6 pivotally secrued thereon. The connecting rod 6 is connected at its upper end with a piston 6*a*, and this piston 6*a* demarcates a combustion chamber in cooperation with a cylinder member which is composed of the cylinder block 1 and the cylinder head 2. The dotted line 0 in the crankcase 5 shows the locus of the big end of the connecting rod. Within the rocker cover 3, a valve actuating mechanism 8 is arranged which comprises a camshaft, a rocker arm and the likes, and this valve actuating mechanism 8 is powered from the crankshaft 7 to actuate the intake valve and exhaust valve for the combustion chamber. To an intake manifold 9 connected with the cylinder head 2, there is connected one end of a breather hose 10 which communicates the rocker cover 3 to the manifold 9. An oil dropping hole 11 and a blow-bye gas rising hole 12 which communicate a top surface 2*a* of the cylinder head 2 to the inside of the crankcase 5 are formed in the cylinder block 1 and the cylinder head 2. The cylinder head top surface 2*a* is adapted to receive an oil OB fed to the valve actuating mechanism 8. The upper end opening 12*a* of the blow-bye gas rising hole 12 is arranged at a position higher than the upper end opening 11*a* of the oil dropping hole 11.

When the engine is started and an oil pump (not shown) is operated, the oil OA reserved in the oil pan 4 is fed to the valve actuating mechanism 8. The oil which has been fed to the valve actuating mechanism 8 drops onto the top surface 2*a* of the cylinder head 2 and is received thereon, and then it is caused to flow down into the crankcase 5 through the oil dropping hole 11. On the other hand, the blow-bye gas which has leaked into the crankcase 5 rises into the rocker cover 3 through the blow-bye gas rising hole 12, and it is caused to flow into the intake manifold 9 through the breather hose 10. The blow-bye gas rising hole 12 also serves as an air inlet hole when the oil OB is returned to the crankcase 5.

After the engine is started and the oil pump (not shown) is operated, a part of the oil OA reserved in the oil pan 4 is sent to the cylinder head through an oil gallery and fed to the valve actuating mechanism 8. The oil OB discharged from the valve actuating mechanism 8 is received on the cylinder head top surface 2*a* and then falls spontaneously so as to return from the oil dropping hole 11 into the crankcase 5.

Within the crankcase 5, on the other hand, an air flow in the direction of an arrow A is generated with the rotation of the crankshaft 7. This air flow is blown into the opening 11*b* of the oil dropping hole 11 which opens into the crankcase 5, as shown by the arrows a, so that it serves as a dynamic pressure in a direction of hindering the flowing-down of oil. The oil dropping hole 11 may be formed so as to have a size enough to effect the dropping of oil regardless of the air flow a. However, it is in fact impossible to form said hole 11 in a large size because of the compactification of the engine. In addition, the quantity of the oil fed to the valve actuating mechanism 8 will be increased as the rotation number of the engine is increased, and as a result, the quantity of the oil OB reserved on the cylinder head top surface 2*a* will be also increased. If the oil quantity is extremely increased, the oil will block the blow-bye gas rising hole 12. The return of oil through the oil dropping hole 11 will be therefore insufficient and the oil quantity to be reserved in the oil pan 4 would be in short supply. Thus, there is such a problem that air is mixed into the oil sent out by the oil pump and the air-mixed oil is fed to a part to be lubricated.

SUMMARY OF THE INVENTION

It is therefore an object of this invention to provide a structure of internal combustion engine in which the above-mentioned problems are dissolved.

According to the present invention, there is provided a structure of internal combustion engine, comprising a cylinder member formed with a cylinder which demarcates a combustion chamber in cooperation with a piston connected with a crankshaft, a crankcase provided in succession with the lower end of said cylinder member to accomodate said crankshaft, a valve actuating mechanism actuating valves provided in said combustion chamber in response to rotation of said crankshaft, at least a part of said valve actuating mechanism being accomodated in a rocker case provided on the upper end of said cylinder member, an oil return passage constituting means opening at one end into said rocker case and at the other end into said crankcase so as to constitute a passage for leading oil in said rocker case into said crankcase, and a restraining means provided in relation to said oil return passage constituting means so that an air flow around the axis of the crankshaft within said crankcase owing to the rotation of said crankshaft is restrained from entering into said passage through the opening of said other end thereof.

The air flow generated by the rotation of the crankshaft does not work as a dynamic pressure of hindering the flowing-down of oil under the effect of the restraining means provided in relation to the oil return passage constituting means.

BRIEF DESCRIPTION OF THE DRAWINGS

The invention will now be described in detail with reference to the accompanying drawings in which.

DESCRIPTION OF THE PREFERRED EMBODIMENTS

Figure 5:
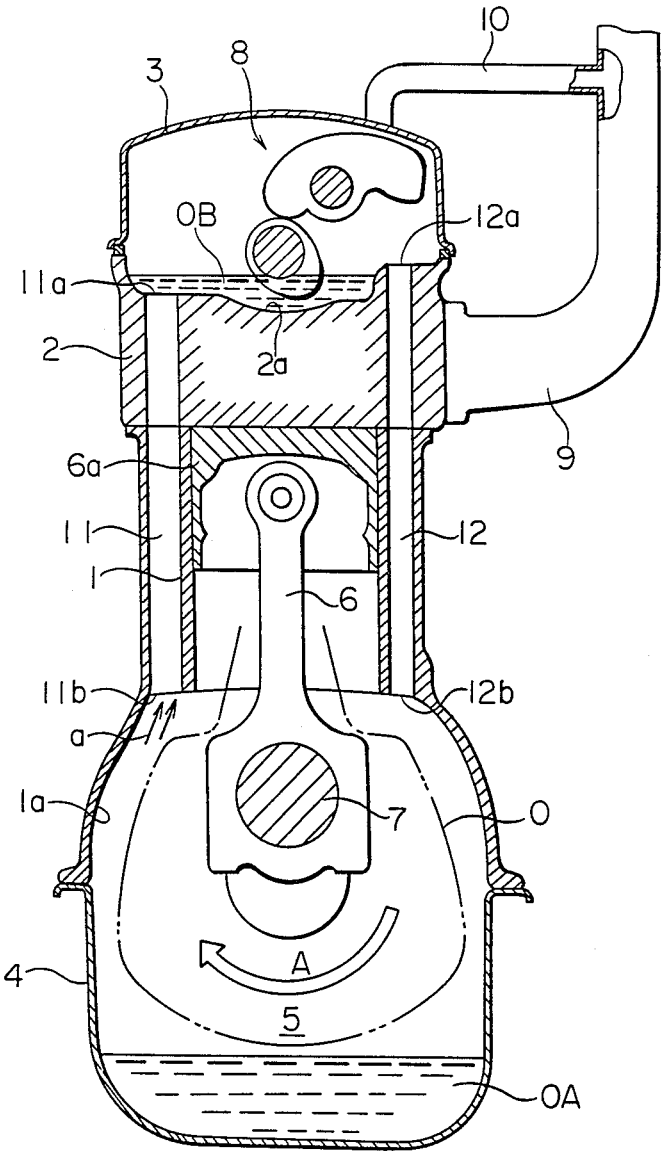
FIG. 5 PRIOR ART
FIG. 5 is a vertical cross-sectional view showing a conventional structure.

As to the same components as the conventional one described with reference to FIG. 5, the same reference numerals will be merely designated to each of those components, but their explanations will be omitted.

Figure 1:
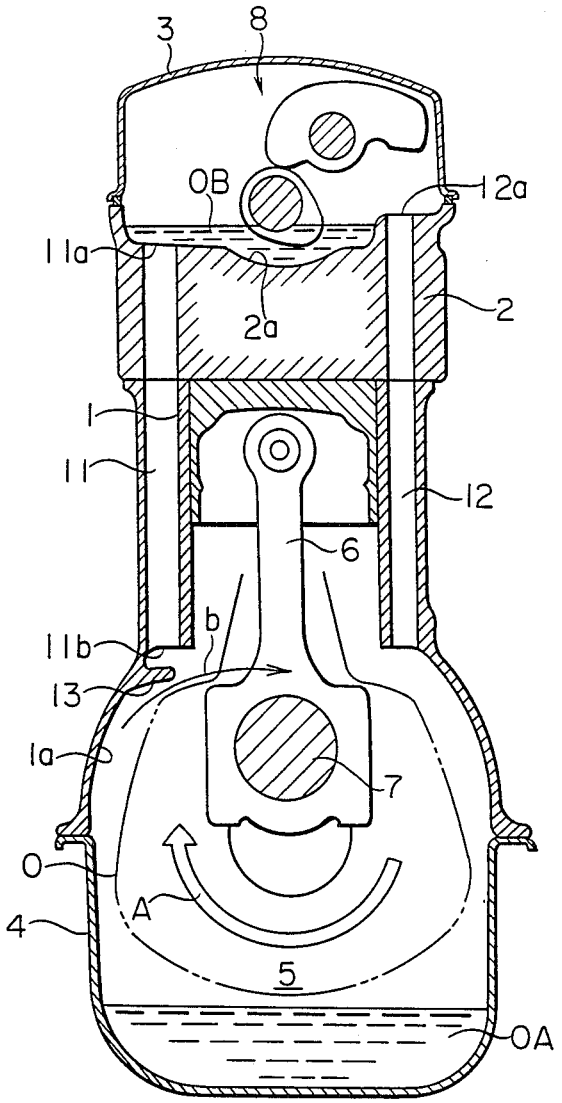
FIG. 1 is a vertical cross-sectional view showing the first embodiment of a structure of engine according to the invention.

The first embodiment of the invention will be described with reference to FIG. 1.

In a cylinder member composed of a cylinder block 1 and a cylinder head 2, an oil dropping hole 11 is perforated as an oil return passage constituting means at one side partitioned by a plane containing the cylinder axis and the crank axis, and a blow-bye gas rising hole 12 is formed at the other side. Said one side is of a side where the big end 0 of a connecting rod 6 and the pin section of a crankshaft 7 on which said big end is mounted occupy when a piston rises, and said other side is of a side where the big end of the connecting rod and the pin section of the crankshaft occupy when the piston descends.

In the flowing direction of air around the crank axis in a crankcase 5, a baffle member 13 for preventing the air flow A from entering into an oil dropping hole 11 is arranged in the vicinity of the upstream side of the opening 11*b* of the oil dropping hole 11 which opens into the crankcase 5. The baffle member 13 shown in the drawings is formed integrally with the skirt portion 1*a* of the cylinder block 1, but it may be secured as a member independent from the cylinder block 1. The baffle member 13 is provided at an enough distance spaced from the opening 11*b* so that the air flow flowing along the skirt portion 1*a* does not hinder the flowing-down of oil, and it is formed so as to have a size as large as the air flow A does not work as a dynamic pressure upon the oil dropping hole 11.

When the crankshaft 7 is rotated and the air flow A is generated in the crankcase 5, this air flow A starts to rise along the skirt portion 1*a*. At that time, the air flow A is guided by means of the baffle member 13, as shown by the arrow b, and it is therefore prevented from entering into the oil dropping hole 11 and rather works to generate a negative pressure which draws out the oil flowing down through the hole 11. Accordingly, even if the rotation number of the engine is increased and the quantity of oil to be sucked is increased, the oil received on the cylinder head top surface 2*a* will be smoothly returned into the crankcase 5, so that the quantity of oil reserved in the oil pan 4 will not be in short.

Figure 2:
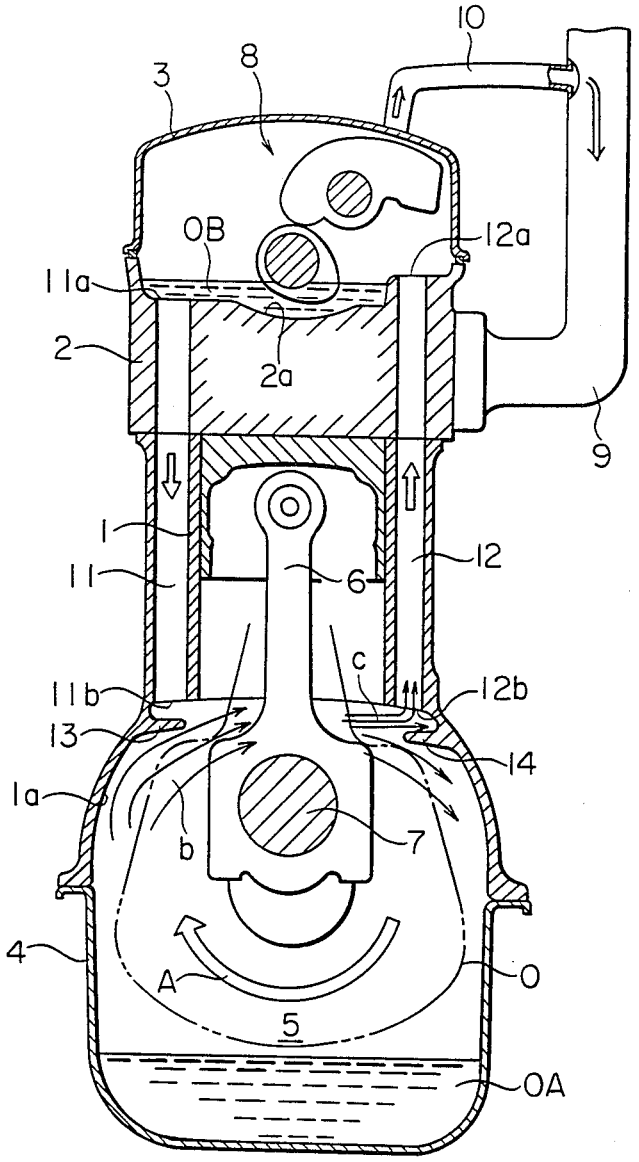
FIG. 2 is a vertical cross-sectional view showing the second embodiment of the invention.

The second embodiment of the invention will be described with reference to FIG. 2.

In this second embodiment, the constitution of an oil returning hole 11 and a baffle member 13 is the same as that of those parts in the above-mentioned first embodiment, and the arrangement of the oil returning hole 11 and a blow-bye gas rising hole 12 is also the same as that of those parts in the above-mentioned first embodiment.

In the vicinity of the opening 12*b* of the blow-bye gas rising hole 12 which opens into a crankcase 5, on the other hand, there is provided a dynamic pressure introduction member 14 at the downstream side of an air flow A in relation to the flowing direction thereof. This dynamic pressure introduction member 14 is formed in such a direction that the air flow A is forcibly introduced into the blow-bye gas rising hole 12, as shown by the arrows c. The dynamic pressure introduction member 14 may be secured as a member independent from the skirt portion 1*a*.

When the crankshaft 7 is rotated and the air flow A is generated in the crankcase 5, this air flow A starts to rise along the skirt portion 1*a*. At that time, the air flow A is guided by means of the baffle member 13, as shown by the arrows b, and it is therefore prevented from entering into the oil returning hole 11 and rather works to generate a negative pressure which draws out the oil flowing down through the hole 11. Also, the air flow A is guided by the dynamic pressure introduction member 14 so as to be positively introduced into the blow-bye gas rising hole 12. Even if the rotation number of the engine is increased and the quantity of oil to be sucked and the generation of blow-bye gas are increased, the dynamic pressure of the air flow A will work as a negative pressure upon the oil returning hole 11 and as a dynamic pressure upon the blow-bye gas rising hole 12. Accordingly, the gas in the crankcase 5 will flow smoothly into the rocker cover 3 and the oil received on the cylinder head top surface 2*a* will return smoothly to the crankcase 5, so that the quantity of the oil reserved in the oil pan 4 will not be in short.

Figure 3:
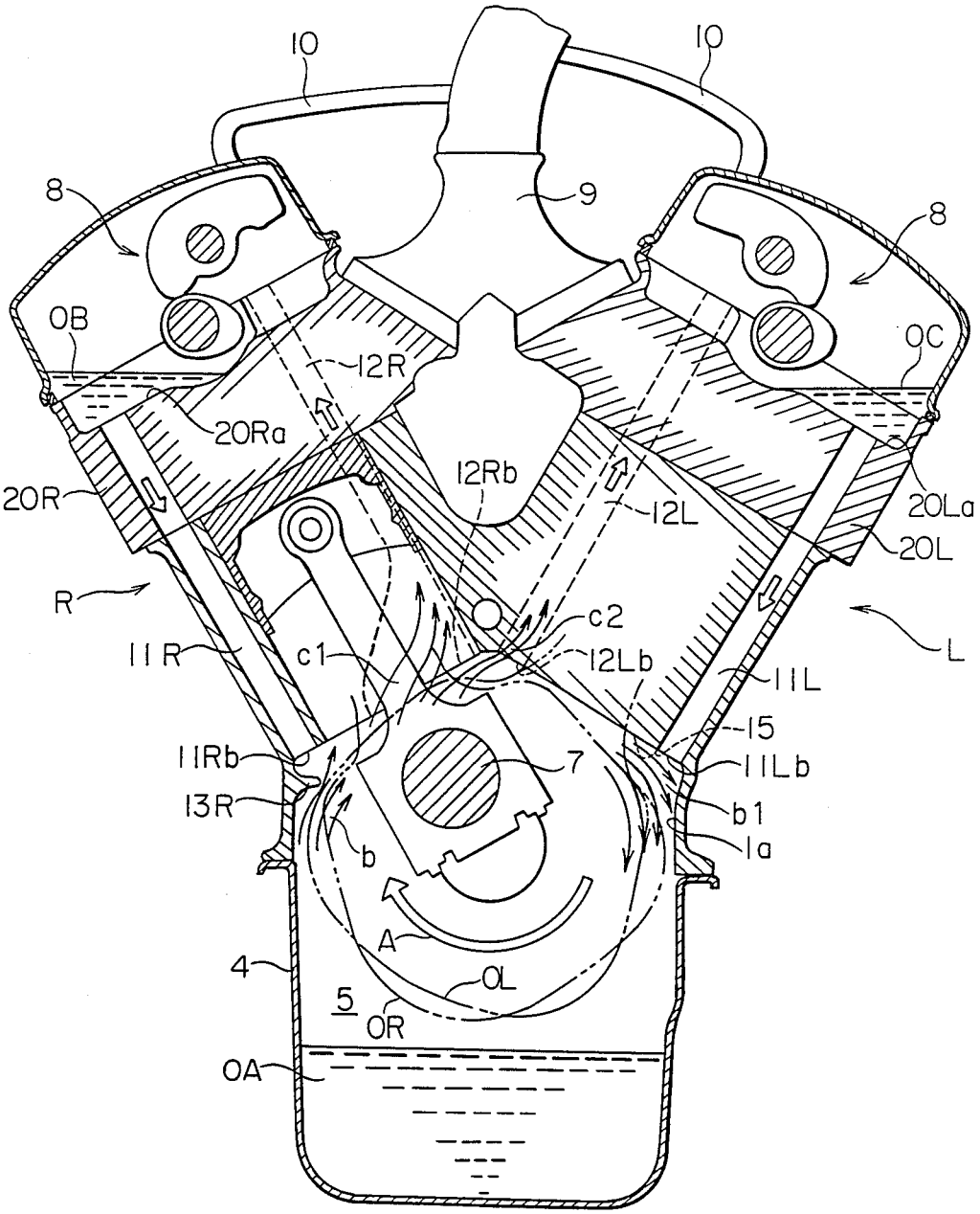
FIG. 3 is a vertical cross-sectional view showing the third embodiment of the invention.

FIG. 3 shows the third embodiment of the invention. The engine shown in this drawing is of a V-type engine in which cylinder groups are divided to a right bank R and a left bank L. A common crankshaft 7 to which pistons arranged in the cylinders of both the right and left banks are connected together is rotated in such a direction that an air flow A is generated. In FIG. 3, the designation OR represents the locus of a connecting rod of the right bank R, and the designation OL represents the locus of a connection rod of the left bank L. In the case of the V-type engine, the oil OB, OC fed to valve actuating mechanisms 8, 8 are retained in the lower sides of the top surfaces 20Ra 20La of inclined cylinder heads 20R, 20L. Oil returning holes 11R and 11L forming an oil return passage constituting means are provided in the outer portions of the cylinder heads 20R, 20L and the cylinder block (further in detail, outside of a plane containing the crank axis and the cylinder axis of each bank). Blowbye gas rising holes 12R and 12L are provided opposite the respective oil returning holes in the inner portion of the engine (further in detail, inside of the plane containing the crank axis and the cylinder axis of each bank).

In the vicinity of the opening 11Rb of the oil returning hole 11R within the crankcase 5, there is provided a baffle member 13R at the upstream side of the air flow A in relation to the flowing direction thereof. The opening 12Rb at the lower end of the blow-bye gas rising hole 12R is formed so as to widen gradually toward the crankcase 5. As the opening 12Lb at the lower end of the blow-bye gas rising hole 12L is opened opposite the air flow A owing to a bank angle, it has not a special opening contour. However, the opening 12Lb may be widened downward along the rotating direction of the crankshaft similarly to the opening 12Rb, or any dynamic pressure introduction member (see the reference numeral 14 in FIG. 2) may be formed at the downstream side of the opening 12Lb. Also, as the opening 11Lb of the other oil returning hole 11L is disposed at a position where the air flows downward as shown by the arrow b1, it has not a special opening contour because a negative pressure resulted from the air flow works thereupon. However, the opening 11Lb may be of an opening with a baffle member 15 provided at its upstream side as shown by the dotted line in FIG. 3 so as to obtain a positive effect of negative pressure.

When the crankshaft 7 is rotated and the air flow A is generated in the crankcase 5, this air flow is guided and caused to flow by the baffle member 13R, as shown by the arrow b, to generate a negative pressure upon the oil returning hole 11R. Then, a part of the air flow enters into the opening 12Rb of the blow-bye gas rising hole 12R widening downward, as shown by the arrow c1. The another part of the air flow enters into the opening 12Lb of the blow-bye gas rising hole 12L opposite the air flow, as shown by the arrow c2, and the rest of the air flow flows downwards along the skirt portion 1*a* as shown by the arrow b1. In the portions indicated by the arrows b and b1, the air flow works to generate a negative pressure upon the openings, thereby to accelerate the flowing-down of oil.

Figure 4:
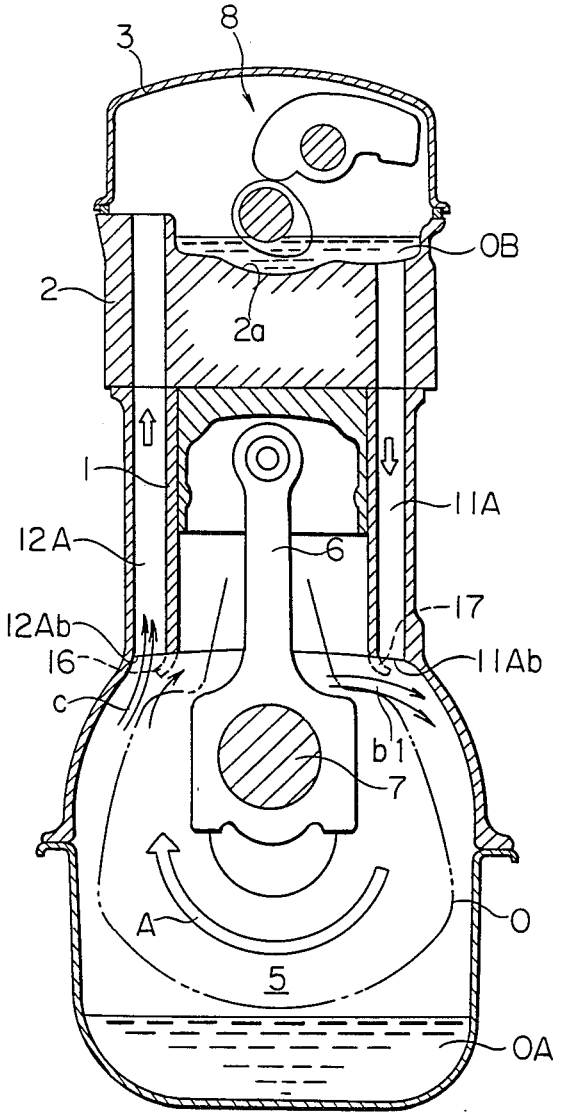
FIG. 4 is a vertical cross-sectional view showing the fourth embodiment of the invention.

FIG. 4 shows the fourth embodiment of the invention. This embodiment is characterized by the arrangement position of the openings of an oil returning hole and a blow-bye gas rising hole which open in a crankcase 5, but not their contour. On the contrary to the first embodiment, namely, the oil returning hole 11A is formed at the side where the big end of the connecting rod 6 and the pin section of the crankshaft 7 occupy when a piston descends, and the blow-bye gas rising hole 12A is formed at the side where said big end and the pin section of the crankshaft occupy when the piston rises. In relation to the flowing direction of an air flow A in the crankcase 5, the opening 11Ab of the oil returning hole 11A is provided downstream of the opening 12Ab of the blow-bye gas rising hole 12A. The opening 12Ab opens opposite the air flow A flowing upwards and is in a position where it receives a dynamic pressure directly therefrom, and the opening 11Ab is in a position where the air flow turns downwards to generate a negative pressure. In this case, it is a matter of course that a dynamic pressure introduction member 16 may be provided at the downstream side of the opening 12Ab and a baffle member 17 at the upstream side of the opening 11Ab, respectively, as shown by the dotted lines in FIG. 4. As shown in FIG. 4, the air flow A containing the blow-bye gas in the crankcase 5 enters into the blow-bye gas rising hole 12A smoothly and works to generate a negative pressure upon the oil returning hole 11A to accelerate the flowingdown of oil.

It will be understood from the foregoing description that the structure of internal combustion engine according to the present invention has the opening of an oil returning hole for obstructing an air flow generated in a crankcase. Accordingly, it is ensured that air is prevented from being mixed into the oil sent out of an oil pan, because the return of oil from a cylinder head into the crankcase can be smoothly carried out.

What is claimed is:

1. A structure of internal combustion engine, comprising a cylinder member formed with a cylinder which demarcates a combustion chamber in cooperation with a piston connected with a crankshaft, a crankcase provided in succession with the lower end of said cylinder member to accommodate said crankshaft, a valve actuating mechanism actuating valves provided in said combustion chamber in response to rotation of said crankshaft, at least a part of said valve actuating mechanism being accommodated in a rocker case provided on the upper end of said cylinder member, an oil return passage constituting means opening at one end into said rocker case, the other end being open into said crankcase at one side which is partitioned by a plane containing the cylinder axis of said cylinder member and the axis of said crankshaft and is occupied by a crank pin of said crankshaft when said piston rises, thereby constituting a passage for leading oil in said rocker case into said crankcase, and a restraining means provided in relation to said oil return passage constituting means so that an air flow around the axis of the crankshaft within said crankcase owing to the rotation of said crankshaft is restrained from entering into said passage through the opening of said other end thereof, said restraining means comprising a baffle member arranged upstream of said air flow in the vicinity of said opening of the other end in said crankcase, said baffle member projecting from a wall of said crankcase toward the inside thereof ane extending in a direction intersecting the flowing direction of said air flow.

2. A structure of internal combustion engine as set forth in claim 1, wherein an oil returning hole constituting said oil return passage is perforated in said cylinder member at one side which is partitioned by a plane containing the cylinder axis of said cylinder member and the axis of said crankshaft and is occupied by a crank pin of said crankshaft when said piston rises, a blow-by gas rising hole being perforated in said cylinder member at the other side partioned by said plane, said blow-by gas rising hole opening at one end into said crankcase and at the other end into said rocker case to lead the gas in said crankcase into said rocker case.

3. A structure of internal combustion engine as set forth in claim 2, wherein a protrusion for leading said air flow from the opening of said one end of the blow-dry gas rising hole into the inside thereof is formed downstream of the air flow in the vicinity of said one end opening.

4. A structure of internal combustion engine comprising a cylinder member formed with a first cylinder or cylinder group and a second cylinder or cylinder group which are arranged in a V-shape, a first piston or piston group cooperating with said first cylinder or cylinder group to define a first combustion chamber or combustion chamber group, a second piston or piston group cooperating with said second cylinder or cylinder group to define a second combustion chamber or combustion chamber group, a common crankshaft connected with said first piston or piston group and said second piston or piston group together, a crankcase provided in succession with the lower end of said cylinder member to accommodate said crankshaft, a first valve actuating mechanism actuating valves provided in said first combustion chamber or combustion chamber group in response to rotation of said crankshaft, a first rocker case provided on the upper end of said cylinder member above said first cylinder or cylinder group so as to accommodate at least a part of said first valve actuating mechanism, a first oil returning hole perforated in said cylinder member outside of a first plane containing the axis of said first cylinder or cylinder group and the axis of said crankshaft, said first oil returning hole being open at one end into said first rocker case and at the other end into said crankcase so as to lead oil in said first rocker case into said crankcase, a second valve actuating mechanism actuating valves provided in said second combustion chamber or combustion chamber group in response to rotation of said crankshaft, a second rocker case provided on the upper end of said cylinder member above said second cylinder or cylinder group so as to accommodate at least a part of said second valve actuating mechanism, a second oil returning hole perforated in said cylinder member outside of a second plane containing the axis of said second cylinder or cylinder group and the axis of said crankshaft, said second oil returning hole being open at one end into said second rocker case and at the other end into said crankcase so as to lead oil in said second rocker case into said crankcase, and a baffle member provided in the vicinity of the other end opening of one of said first oil returning hole and said second oil returning hole which is positioned upstream in relation to the rotating direction of said crankshaft, said baffle member being positioned upstream of said other end opening in relation to an air flow around the axis of the crankshaft within said crankcase owing to the rotation of said crankshaft so that said air flow is restrained from entering into said one oil returning hole through said other end opening thereof.

5. A structure of internal combustion engine as set forth in claim 4, wherein said cylinder member is formed with a first blow-by gas rising passage and a second blow-by gas rising passage, said first blow-by gas rising passage communicating at one end into said crankcase and at the other end into said first rocker case to lead the gas in said crankcase into said first rocker case, said first blow-by gas rising passage being perforated in said cylinder member inside of said first plane, said second blow-by gas rising passage communicating at one end into said crankcase and at the other end into said second rocker case to lead the gas in said crankcase into said second rocker case, said second blow-by gas rising passage being perforated in said cylinder member inside of said second plane.

6. A structure of internal combustion engine, comprising a cylinder member formed with a cylinder which demarcates a combustion chamber in cooperation with a piston connected with a crankshaft, a crankcase provided in succession with the lower end of said cylinder member to accommodate said crankshaft, a valve actuating mechanism actuating valves provided in said combustion chamber in response to rotation of said crankshaft, at least a part of said valve actuating mechanism being accommodated in a rocker case provided on the upper end of said cylinder member, an oil returning hole perforated in said cylinder member at one side which is partitioned by a plane containing the cylinder axis of said cylinder member and the axis of said crankshaft and is occupied by a crank pin of said crankshaft when said piston descends, said oil returning hole opening at one end into said rocker case and at the other end into said crankcase so as to constitute a passage for leading oil in said rocker case into said crankcase, and a blow-by gas rising hole perforated in said cylinder member at the other side partitioned by said plane, said blow-by gas rising hole opening at one end into said crankcase and at the other end into said rocker case to lead the gas in said crankcase into said rocker case, said other end opening of said oil returning hole being formed at a position that is out of place from the flowing direction of said air flow, so that said air flow is restrained from entering into the oil returning hole through said other end opening thereof.

* * * * *